US005426808A

United States Patent [19]

Snow

[11] Patent Number: 5,426,808

[45] Date of Patent: Jun. 27, 1995

[54] DEVICES FOR CLEANING PRONGS OF FORKS

[76] Inventor: Boyd R. Snow, 9615 Hillcreek La., Santee, Calif. 92071

[21] Appl. No.: 188,693

[22] Filed: Jan. 31, 1994

[51] Int. Cl.[6] ..... A46B 3/18

[52] U.S. Cl. ..... 15/160; 15/104.53

[58] Field of Search ..... 15/160, 104.51, 104.52, 15/104.53, 104.50

[56] References Cited

U.S. PATENT DOCUMENTS

| | | | |
|---|---|---|---|
| 672,575 | 4/1901 | Fleming, Jr. | 15/104.53 |
| 979,660 | 12/1910 | Felder | 15/104.53 |
| 1,040,849 | 10/1912 | Bercha | 15/104.52 |
| 1,250,446 | 12/1917 | Gloeckler | 15/104.53 |
| 1,412,860 | 4/1922 | Gran | 15/104.52 |
| 2,036,527 | 4/1936 | Inman | 15/104.52 |
| 2,777,146 | 1/1957 | McDonald | 15/104.52 |
| 4,534,670 | 8/1985 | Facuseh | 15/104.53 |

FOREIGN PATENT DOCUMENTS

| | | | |
|---|---|---|---|
| 328403 | 10/1920 | Germany | 15/104.52 |
| 197804 | 4/1978 | Germany | 15/206 |
| 12310 | of 1915 | United Kingdom | 15/206 |

*Primary Examiner*—David A. Scherbel
*Assistant Examiner*—Tony G. Soohoo

[57] ABSTRACT

A device for cleaning prongs of forks comprising a housing having a rectangular bottom wall having elongated parallel front and rear edges and having shortened parallel side edges, a pair of side walls in a rectangular shape having elongated parallel upper and lower edges and parallel front and rear edges, the lower edge of the side walls being coupled to the side edges of the bottom wall. A pair of strands of wires extend in twisted relationship one with the other and each secured at its opposite end to an aperture in the-opposed side walls. A plurality of bristles are secured along the lengths of the wires between the side walls and extending radially outward therefrom in all directions around the circumference of the wires to present irregular exterior surfaces of triangular configurations with peaks and valleys, the peaks and valleys of each strand being positioned with respect to the peaks and valleys of the bristles of the next adjacent wires.

3 Claims, 4 Drawing Sheets

DEVICES FOR CLEANING PRONGS OF FORKS

BACKGROUND OF THE INVENTION

1. Field of the Invention

The present invention relates to devices for cleaning prongs of forks and more particularly pertains to cleaning the prongs of forks by movement with respect to fixed bristles.

2. Description of the Prior Art

The use of cleaning devices is known in the prior art. More specifically, cleaning devices heretofore devised and utilized for the purpose of removing dirt from articles are known to consist basically of familiar, expected, and obvious structural configurations, notwithstanding the myriad of designs encompassed by the crowded prior art which has been developed for the fulfillment of countless objectives and requirements.

The prior art discloses many types of cleaning devices. By way of example, U.S. Pat. No. 3,629,895 to Colgan discloses a brush for cleaning kitchen utensils and method for making same.

U.S. Pat. No. 3,784,999 to Preston discloses a cleaner for forks.

U.S. Pat. No. 3,964,120 to Woodford discloses a comb cleaner.

U.S. Pat. No. 4,534,670 to Facusch discloses a cleaning device.

Lastly, U.S. Pat. No. 4,803,750 to Christopher discloses a fork and comb cleaning tool.

In this respect, the devices for cleaning prongs of forks according to the present invention substantially depart from the conventional concepts and designs of the prior art, and in doing so provide an apparatus primarily developed for the purpose of cleaning the prongs of forks by movement with respect to fixed bristles.

Therefore, it can be appreciated that there exists a continuing need for new and improved devices for cleaning prongs of forks which can be used for cleaning the prongs of forks by movement with respect to fixed bristles. In this regard, the present invention substantially fulfills this need.

SUMMARY OF THE INVENTION

In view of the foregoing disadvantages inherent in the known types of cleaning devices now present in the prior art, the present invention provides improved devices for cleaning prongs of forks. As such, the general purpose of the present invention, which will be described subsequently in greater detail, is to provide new and improved devices for cleaning prongs of forks and method which has all the advantages of the prior art and none of the disadvantages.

To attain this, the present invention essentially comprises new and improved devices for cleaning prongs of forks comprising a housing having a rectangular bottom wall having elongated parallel front and rear edges and having shortened parallel side edges, a pair of side walls in a rectangular shape having elongated parallel upper and lower edges and parallel front and rear edges, the lower edge of the side walls being coupled to the side edges of the bottom wall. A pair of strands of wires extend in twisted relationship one with the other and each secured at its opposite end to an aperture in the opposed side walls, the pair of wires being formed into a single strand threaded alternately through apertures in the opposed end walls and secured in position at the ends of the wires. A plurality of plastic bristles are secured along the lengths of the wires between the side walls and extending radially outward therefrom in all directions around the circumference of the wires to present irregular exterior surfaces of triangular configurations with peaks and valleys, the peaks and valleys of each strand being positioned with respect to the peaks and valleys of the bristles of the next adjacent wires. Adjustment means are provided for varying the tautness of the wires from side wall to side wall, the adjustment means including a plurality of rods, each rod having an inboard end positioned within a similarly shaped tubular recess in the adjacent extent of the bottom wall, each rod having its outboard end secured to one side wall at the lower extent thereof to allow sliding motion of one side wall toward and away from the other, a short fixed plate extending upwardly from the side edge of the bottom wall adjacent to the movable side wall, the short fixed plate having a pair of threaded apertures therethrough and a pair of thumb screws extending therethrough whereby rotation of the thumb screw in one direction will move the movable side wall away from the fixed plate to tighten the wires while rotation in the opposite direction will allow movement of the movable side wall toward to fixed plate for loosening wires.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved devices for cleaning prongs of forks which have all the advantages of the prior art cleaning devices and none of the disadvantages.

It is another object of the present invention to provide new and improved devices for cleaning prongs of forks which may be easily and efficiently manufactured and marketed.

It is further object of the present invention to provide new and improved devices for cleaning prongs of forks which are of durable and reliable constructions.

An even further object of the present invention is to provide new and improved devices for cleaning prongs of forks which are susceptible of a low cost of manufacture with regard to both materials and labor, and which accordingly are then susceptible of low prices of sale to the consuming public, thereby making such devices for cleaning prongs of forks economically available to the buying public.

Still yet another object of the present invention is to provide new and improved devices for cleaning prongs of forks which provide in the apparatuses and methods of the prior art some of the advantages thereof, while simultaneously overcoming some of the disadvantages normally associated therewith.

Even still another object of the present invention is to clean the prongs of forks by movement with respect to fixed bristles.

Lastly, it is an object of the present invention to provide new and improved devices for cleaning prongs of forks comprising a housing having a rectangular bottom wall having elongated parallel front and rear edges and having shortened parallel side edges, a pair of side walls in a rectangular shape having elongated parallel upper and lower edges and parallel front and rear edges, the lower edge of the side walls being coupled to the side edges of the bottom wall. A pair of strands of wires extend in twisted relationship one with the other and each secured at its opposite end to an aperture in the opposed side walls. A plurality of bristles are secured along the lengths of the wires between the side walls and extending radially outward therefrom in all directions around the circumference of the wires to present irregular exterior surfaces of triangular configurations with peaks and valleys, the peaks and valleys of each strand being positioned with respect to the peaks and valleys of the bristles of the next adjacent wires.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
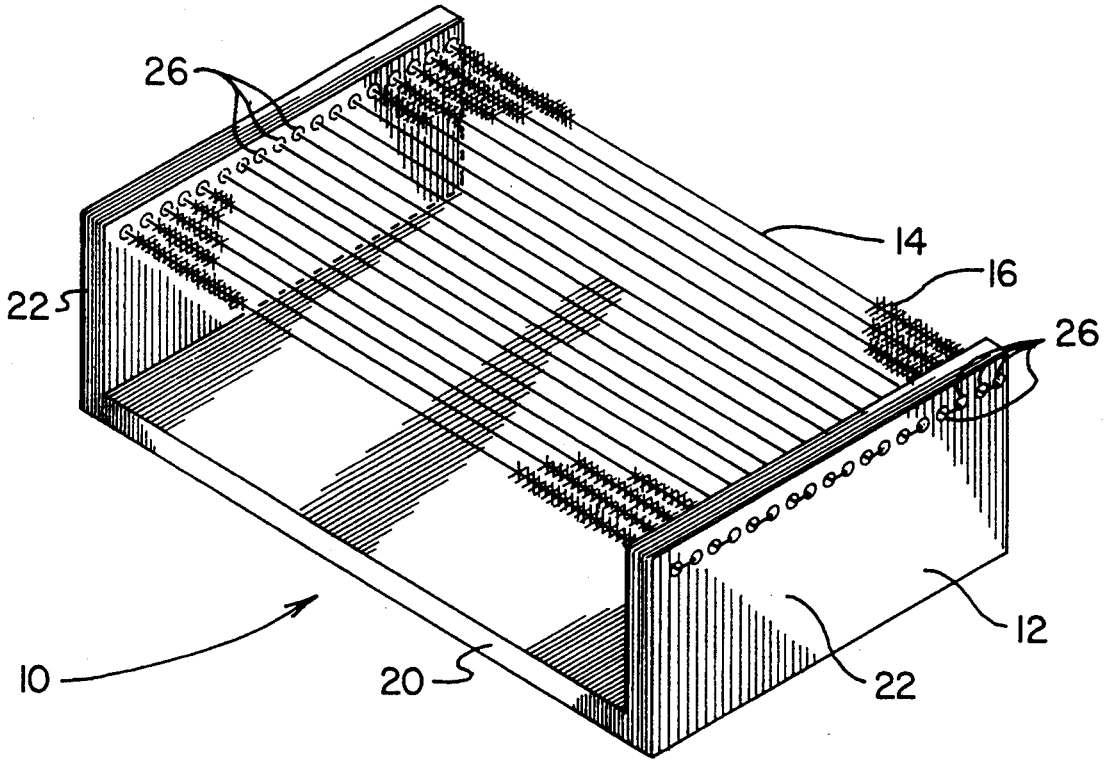
FIG. 1 is a perspective view of the preferred embodiment of the devices for cleaning prongs of forks constructed in accordance with the principles of the present invention.
Figure 2:
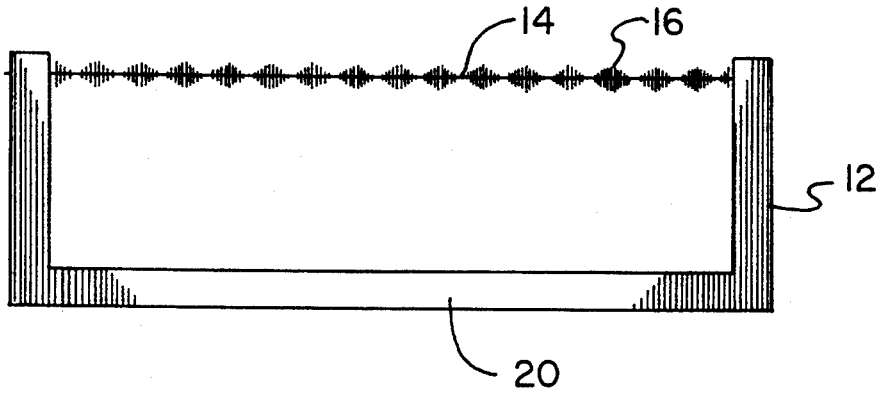
FIG. 2 is a front elevational view of the cleaning device shown in FIG. 1.
Figure 3:
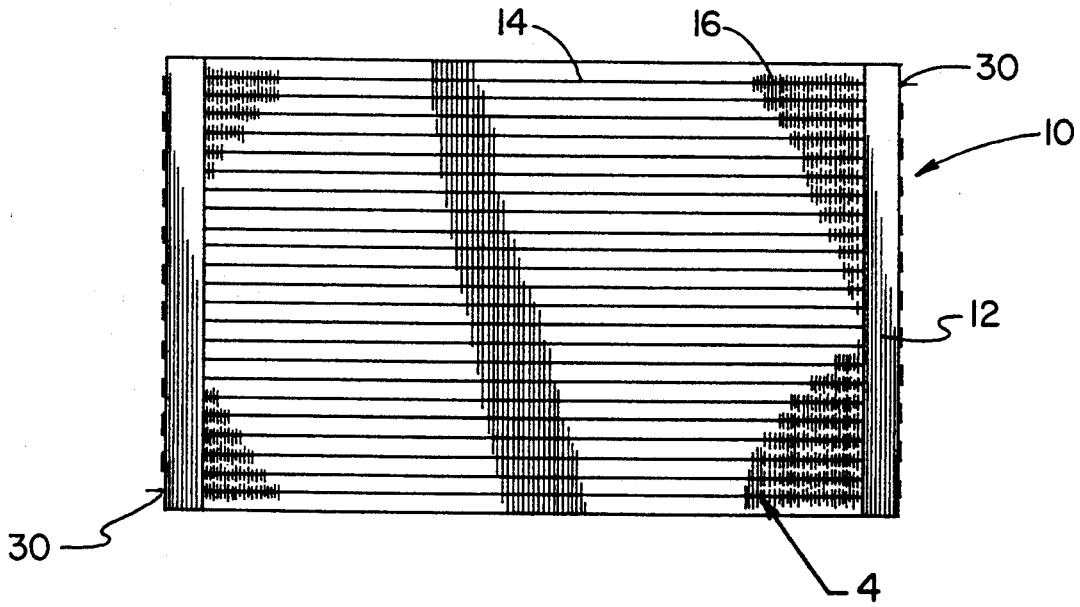
FIG. 3 is a top plan view of the cleaning device shown in the prior Figures.
Figure 4:
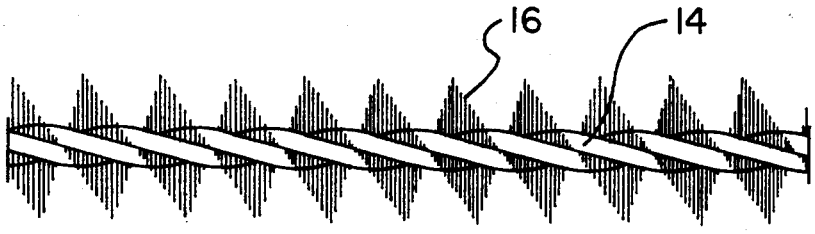
FIG. 4 is an enlarged end elevational view of a portion of one strand of wire and bristles taken along line 4—4 of FIG. 3.
Figure 5:
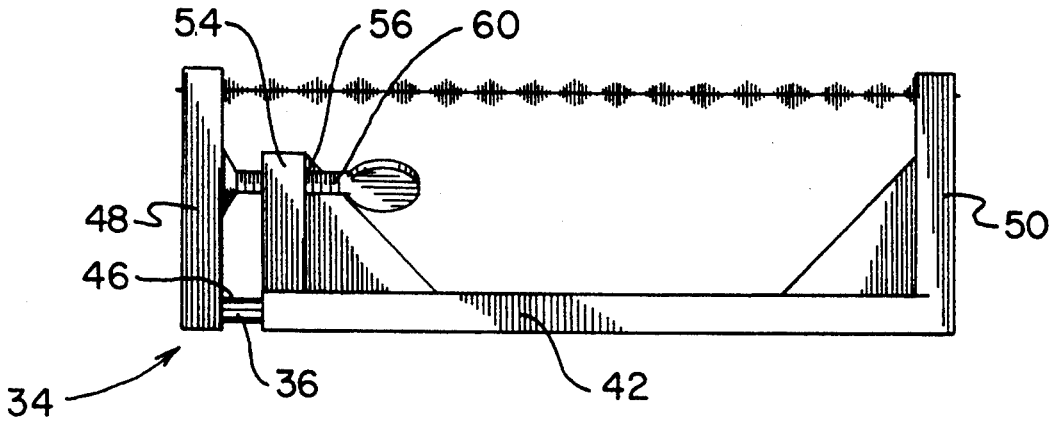
FIG. 5 is a front elevational view similar to FIG. 2 but illustrating an alternate embodiment of the invention.
Figure 6:
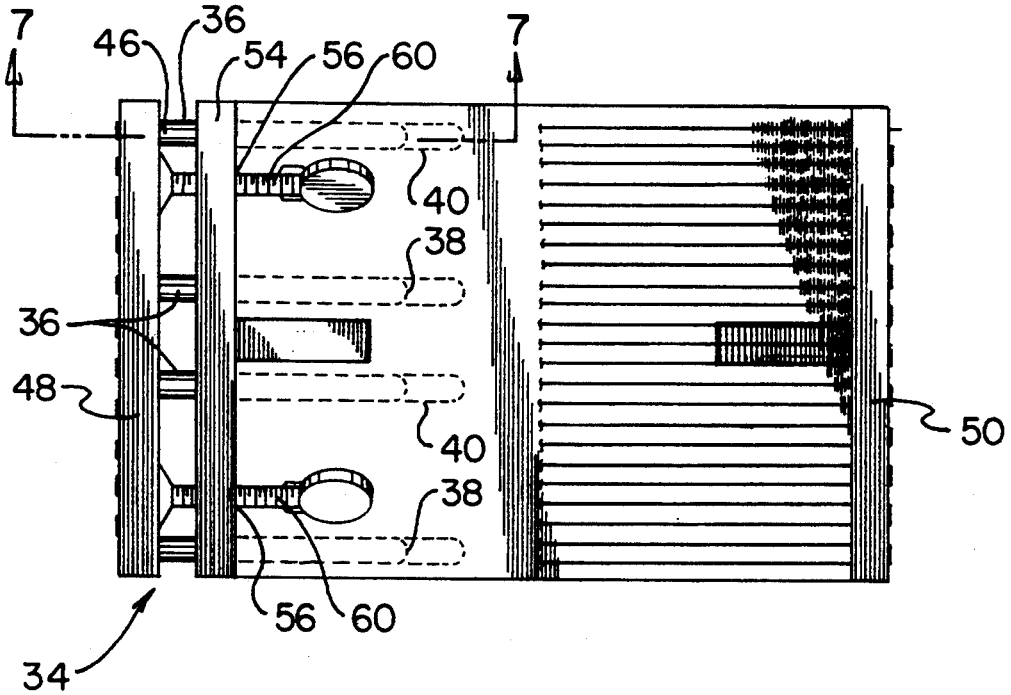
FIG. 6 is a top plan view of the cleaning device illustrated in FIG. 5.
Figure 7:
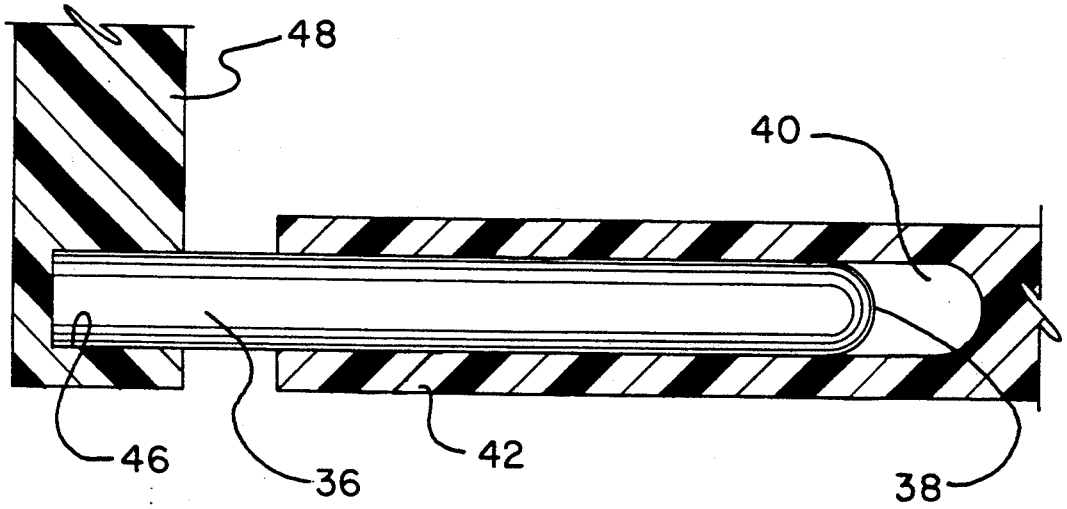
FIG. 7 is a cross sectional view of the cleaning device shown in FIG. 6 taken along line 7—7 of FIG. 6.

With reference now to the drawings, and in particular to FIG. 1 thereof, the preferred embodiment of the new and improved devices for cleaning prongs of forks embodying the principles and concepts of the present invention and generally designated by the reference numeral 10 will be described.

Specifically, it will be noted in FIGS. 1 through 4 that a new and improved device for cleaning prongs of forks 10 is disclosed. Such cleaning device comprises, in its broadest context, a housing 12, a pair of strands of twisted wire 14, and bristles 16 extending outwardly therefrom.

More specifically, the housing 12 is formed with a rectangular bottom wall 20. The bottom wall has elongated parallel front and rear edges and shortened parallel side edges. A pair of side walls 22 are in a rectangular shape. The side walls have parallel upper and lower edges and parallel front and rear edges. The lower edges of the side walls 22 are coupled to the side edges of the bottom wall 20. In the primary embodiment of FIGS. 1 through 4, such coupling is fixed to form a fixedly oriented housing 12.

The next element of the device 10 is a pair of strands of wire 14. The wires extend in a linear orientation and are in a twisted relationship one wire with respect to the other wire. The wires extend in linear array parallel with each other from end wall to end wall. Their positioning is ensured by their extending through parallel apertures 26 formed in the end walls in a planar array parallel to the bottom wall. In the preferred embodiment, the pair of wires are formed into a single strand which is threaded alternately through adjacent apertures 26 in the opposed end walls 22. Securement is made by a knot 30 at the opposite ends of the wires.

The actual cleaning of forks is effected through bristles 16. The bristles are preferably formed of a relatively stiff and hard plastic material. The bristles are secured along the lengths of the wires 14 between the side walls 22. The bristles each extend radially outwardly from the wires in all directions around the circumference of the wires. [This presents irregular exterior surfaes, preferably formed in triangular configurations. Such triangles created peaks and valleys with the peaks and valleys of each strand being positioned with respect to the peaks and valleys of the bristles of the next adjacent wires to maximize the cleaning effect on fork prongs.]

An alternate embodiment of the invention is shown in FIGS. 5 through 8. In such embodiment, adjustment means 34 are provided for increasing or decreasing the tautness of the wires from side wall to side wall 22. The adjustment means 34 includes a plurality of rods 36 shown in the preferred embodiment of FIG. 6. Each rod 36 has an inboard end 38. The inboard end is positioned within a similarly shaped tubular recess 40 formed in the adjacent extent of the bottom wall 42. Each rod also has an outboard end 46. Each outboard end is secured to one side wall 48 at the lower extent thereof. This allows for sliding movement of one side wall 48 with respect to the other side wall 50.

A short fixed plate 54 extends upwardly from the side edge of the bottom wall 42 adjacent to the moveable side wall 48. The short fixed plate 54 has a pair of threaded apertures 56 extending therethrough. A pair of thumb screws 60 extend through the apertures 56. In this manner, rotation of the thumb screws 60 in one direction will move the moveable side wall 48 away from the fixed plate 54 and opposite side wall 50 to tighten the wires. Rotation in the opposite direction will allow movement of the moveable side wall 48 toward the fixed plate 54 and opposite side wall 50 for loosening the wires.

The present invention is designed to thoroughly clean the tines of a fork quickly and easily while in the process of cleaning other utensils and dishes. It is made of plastic in the form of a rectangular tray which, in the preferred embodiment of the invention, measures five inches long by three inches wide. A series of light gauge wires are stretched tautly across the longer dimension of the tray and these wires are covered with short plastic bristles which extend radially outwardly from around the entire outside diameter of the wires. The wires are spaced in increments of approximately one eight of an inch. An alternate cleaning medium would be strands which are similar to pipe stem cleaners.

In use, the present invention is immersed into the dish water and cleaner being used for other dishes. Then, each time a fork is to be cleaned, it is a simple matter to plunge the tines through the wires and rapidly move the fork back and forth. With just a few strokes, the areas between the tines and those at the rounded base of each will be thoroughly cleaned and purged of stubborn particles such as egg yolk and other dried food. The alternative is not attractive and usually entails an attempt to push a corner or an edge of a dish cloth through the tine clearance area. This is not only tedious and dangerous, but, many cleaning cloths are ruined in the process.

The present invention is simply fabricated, lends itself readily to high volume production and can be inexpensively manufactured.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved device for cleaning prongs of forks comprising, in combination:

a housing having a rectangular bottom wall having elongated parallel front and rear edges and having shortened parallel side edges, a pair of side walls in a rectangular shape having elongated parallel upper and lower edges and front and rear edges and with parallel apertures adjacent to the upper edges of the side walls, the lower edge of the side walls being coupled to the side edges of the bottom wall with the openings formed above the front and rear edges of the bottom wall;

a pair of strands of wires extending in twisted relationship one with the other to form a twisted pair and each twisted pair secured at its end to one aperture in one sidewall and looped back and forth between the opposed side walls to form a cleaning plane parallel with the bottom wall;

a plurality of plastic bristles secured along the lengths of the twisted pair between the side walls and extending radially outward therefrom in all directions around the circumference of the twisted pair; and adjustment means for varying the tautness of the wires from side wall to side wall, the adjustment means including a plurality of rods, each rod having an inboard end positioned within a similarly shaped tubular recess in an adjacent extent of the bottom wall, each rod having its outboard end secured to one side wall at a lower extent thereof to allowing sliding motion of one side wall toward and away from the other, a short fixed plate extending upwardly from the side edge of the bottom wall adjacent to the one side wall, the short fixed plate having a pair of threaded apertures therethrough and a pair of thumb screws extending therethrough whereby rotation of the thumb screw in one direction will move the one side wall away from the fixed plate to tighten the twisted pairs while rotation in the opposite direction will allow movement of the one side wall toward the fixed plate for loosening twisted pairs.

2. A device for cleaning prongs of forks comprising:

a housing having a rectangular bottom wall having elongated parallel front and rear edges and having shortened parallel side edges, a pair of side walls in a rectangular shape having elongated parallel upper and lower edges and front and rear edges and with parallel apertures adjacent to the upper edges of the side walls, the lower edge of the side walls being coupled to the side edges of the bottom wall with the openings formed above the front and rear edges of the bottom wall;

a pair of strands of wires extending in twisted relationship one with the other to form a twisted pair and each twisted pair secured at its end to one aperture in one sidewall and looped back and forth between the opposed side walls to form a cleaning plane parallel with the bottom wall; and a plurality of plastic bristles secured along the lengths of the twisted pair between the side walls and extending radially outward therefrom in all directions around the circumference of the twisted pair.

3. The device as set forth in claim 2 and further including:

adjustment means for varying the tautness of the wires from side wall to side wall, the adjustment means including a plurality of rods, each rod having an inboard end positioned within a similarly shaped tubular recess in an adjacent extent of the bottom wall, each rod having its outboard end secured to one side wall at a lower extent thereof to allowing sliding motion of one side wall toward and away from the other, a short fixed plate extending upwardly from the side edge of the bottom wall adjacent to the one side wall, the short fixed plate having a pair of threaded apertures therethrough and a pair of thumb screws extending therethrough whereby rotation of the thumb screw in one direction will move the one side wall away from the fixed plate to tighten the twisted pairs while rotation in the opposite direction will allow movement of the one side wall toward the fixed plate for loosening twisted pairs.

* * * * *